United States Patent [19]

Hisatake et al.

[11] 4,406,238

[45] Sep. 27, 1983

[54] SEWING MACHINE WITH CYCLIC PATTERN STITCHING DEVICE

[75] Inventors: Michio Hisatake, Fujino; Yasuro Sano, Hachioji, both of Japan

[73] Assignee: Janome Sewing Machine Co. Ltd., Tokyo, Japan

[21] Appl. No.: 260,287

[22] Filed: May 4, 1981

[30] Foreign Application Priority Data

May 23, 1980 [JP] Japan ..... 55-70264[U]

[51] Int. Cl.[3] ..... D05B 69/18; D05B 3/02

[52] U.S. Cl. ..... 112/277; 112/158 A

[58] Field of Search ..... 112/275, 277, 158 A, 112/158 B, 158 D, 121.11

[56] References Cited

U.S. PATENT DOCUMENTS 4,195,582 4/1980 Novick et al. ..... 112/275 X 4,265,188 5/1981 Suzuki et al. ..... 112/275 X 4,331,092 5/1982 Hisatake et al. ..... 112/158 A X

*Primary Examiner*—Peter P. Nerbun

*Attorney, Agent, or Firm*—Michael J. Striker

[57] ABSTRACT

A sewing machine has a group of pattern cams arranged to cooperate with a needle to produce a pattern per cycle rotation thereof, a user-operated pattern selecting device arranged to be manipulated for selecting the pattern cams to control a lateral swinging movement of the needle, a machine stopping device, pattern cycle selecting device operated to select one of pattern cycles to automatically stop the sewing machine after a selected pattern has been formed up in a selected pattern cycle, a device for detecting a termination of a pattern cycle and producing an electrical signal each time it detects the termination of the pattern cycle, a counter device responding to a predetermined number of the electrical signals of the pattern cycle detecting device to produce a pulse signal, and machine stopping device responding to the pulse signal of the counter device to operate the machine stopping device to stop the sewing machine.

4 Claims, 4 Drawing Figures

SEWING MACHINE WITH CYCLIC PATTERN STITCHING DEVICE

BACKGROUND OF THE INVENTION

The invention relates to a sewing machine and more particularly relates to a cyclic pattern stitching device of a sewing machine which is automatically stopped with the needle detained at a predetermined position after at least one pattern is stitched up at least in one-cycle rotation of a selected pattern cam.

In the conventional pattern stitching sewing machine employing pattern cams rotated at a reduced speed by the drive shaft of the sewing machine, the initial stitch of a pattern is produced at random in dependence upon the angular position of a pattern cam at which the cam is stopped when the sewing machine is standstill, and it is almost impossible to expect that the selected pattern is produced from the initial starting point of the pattern cam. This is inconvenient in case the same patterns or different patterns are produced in sequence. In case of stitching such a combination of patterns, it is desirable that the sewing machine is started from the initial stitch coordinate of the pattern determined by the pattern cam and automatically stops at the last stitch coordinate of the pattern determined by the pattern cam for the purpose of stitching the next pattern from the initial stitch coordinate thereof. With the conventional pattern stitching sewing machine, it is very difficult and almost impossible to do such a pattern stitching operation only by manipulating the machine controller stopping and starting the sewing machine at a desired stitch coordinates of the pattern. In order to solve such a problem, the same assignee filed a Japanese utility model application No. 106 126/79 (U.S. patent application Ser. No. 175 203 by HISATAKE, KASUGA and SANO) disclosing the art to automatically stop the sewing machine with the needle stopped at a predetermined position after a single pattern has been formed up in one-cycle rotation of a selected pattern cam, but not after a plurality of patterns have been sequentially formed up.

SUMMARY OF THE INVENTION

The present invention has been provided to further improve the subject matter of the Japanese utility model application No. 106 126/79. According to the present invention, the sewing machine is automatically stopped with the needle stopped at a predetermined position after a plurality of patterns have been sequentially stitched in the corresponding number of cycle rotation or rotations of a selected pattern cam. For attaining this object, the sewing machine of the invention substantially comprises a pattern selecting device, operated to select one of the pattern cycles to stop the sewing machine after one or more number of patterns have been sequentially produced in one or more predetermined number of revolutions a selected pattern cam, a device detecting the termination of the pattern cycle and producing a pulse signal each time it detects the termination of the pattern cycle, a counter counting up the pulse signal of the pattern cycle detecting device and producing a pulse in response to one or a predetermined number of pulses of the pattern cycle detecting device, a stopping device operated in response to the pulse of the counter to stop the sewing machine with the needle stopped at a predetermined position, and a switching device for changing over the cyclic stitching of a pattern to the normal stitching of a pattern which is implemented solely in accordance to a pattern cam selected by the pattern cam selecting device.

DETAIL DESCRIPTION OF THE INVENTION

Figure 1:
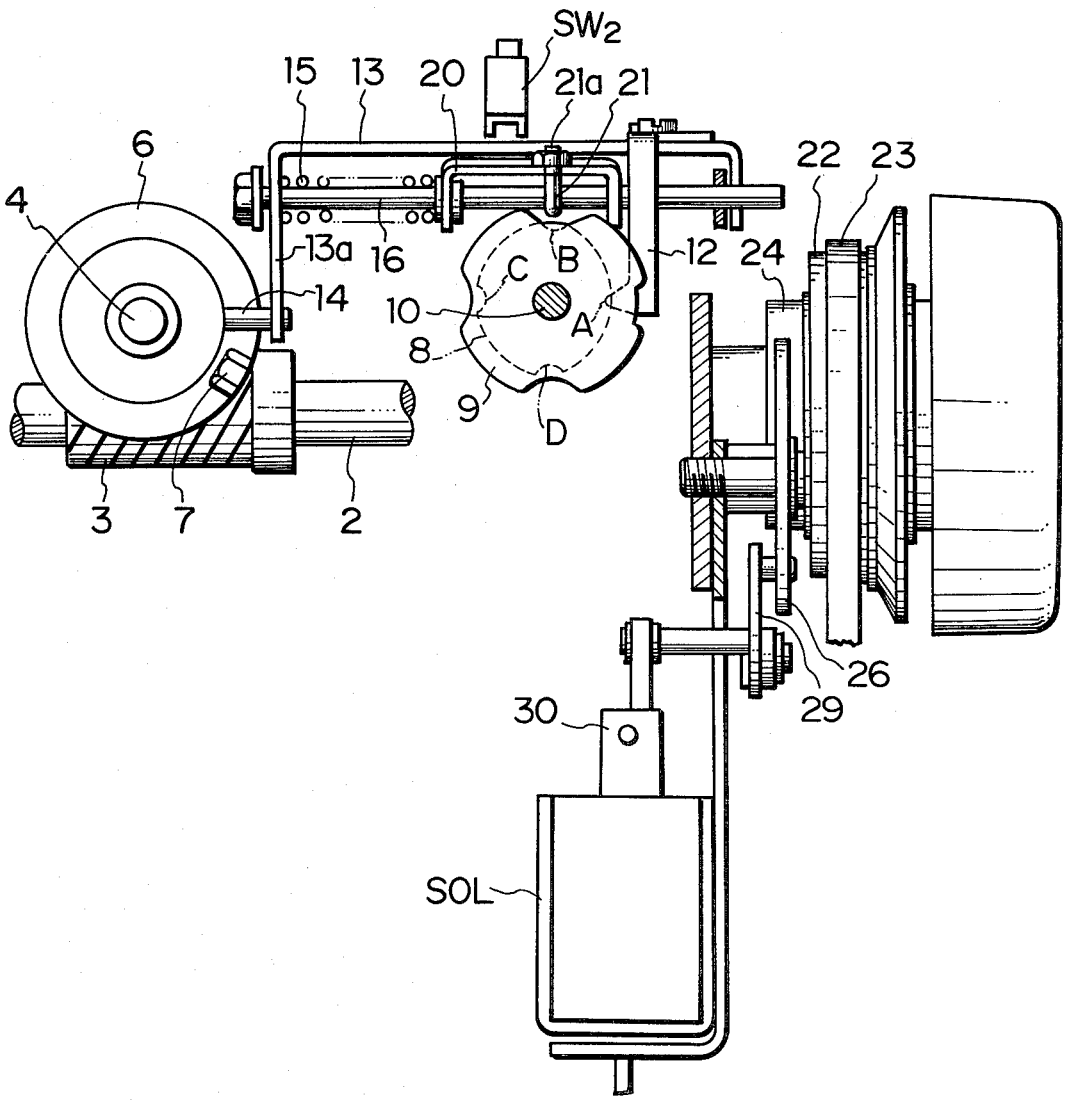
FIG. 1 is an outlined front elevational view of the invention.
Figure 2:
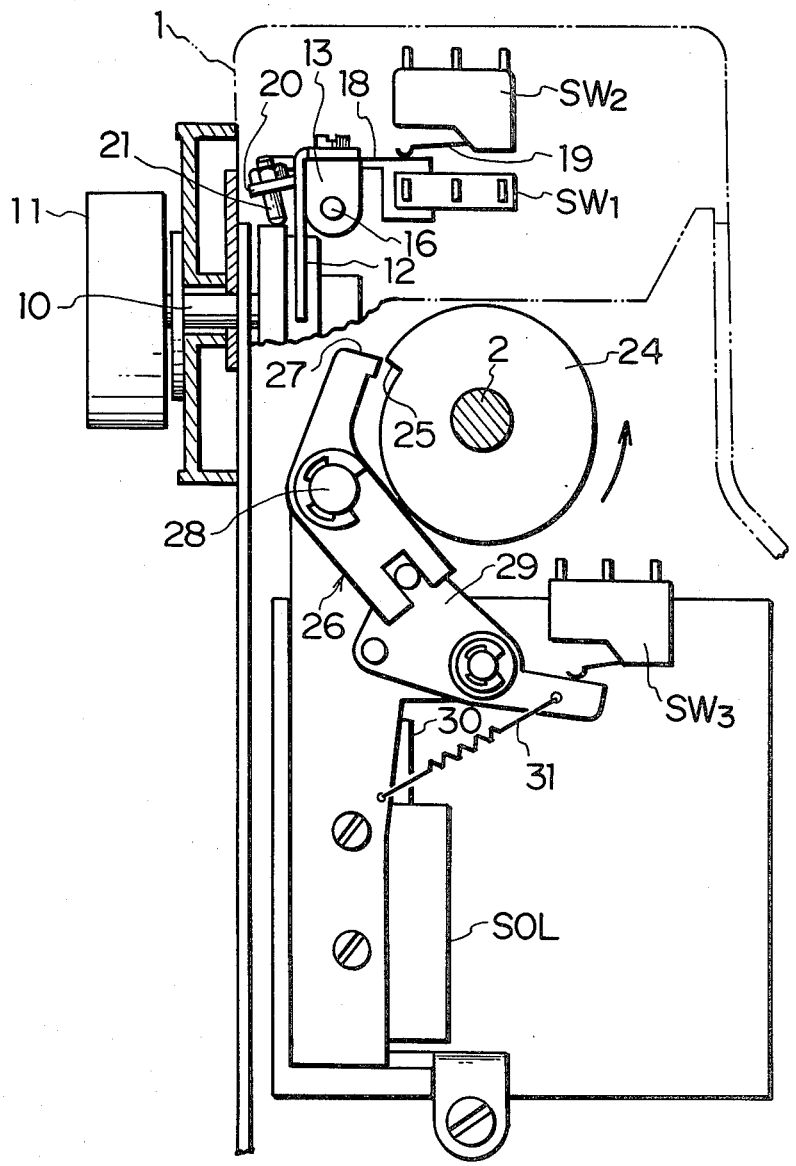
FIG. 2 is a side elevational view of the invention.
Figure 3:
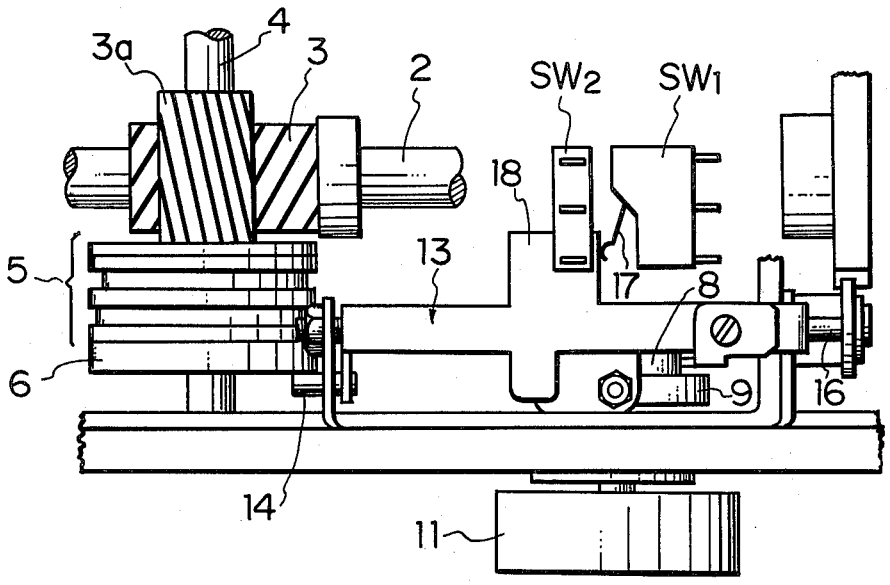
FIG. 3 is a plan view of the invention.

In reference to FIGS. 1–3, the sewing machine has an upper drive shaft 2 rotatably mounted in a machine housing 1 as generally known. A transverse cam shaft 4 is rotatably mounted in the machine housing 1. A number of pattern cams 5 and a pattern cycle detecting cam 6 are secured to the transverse cam shaft 4 for rotation therewith. The upper drive shaft 2 has a worm 3 secured thereto for rotation therewith, and the transverse cam shaft 4 has another worm 3*a* secured thereto. These worms 3, 3*a* are in mesh with each other so that the rotation of the upper drive shaft 2 may be transmitted to the cams.

A pattern cam selecting device, though it is not shown, is manually operated to selectively engage a cam follower to the pattern cams 5, thereby to control the lateral swinging movement of the needle of the sewing machine in a manner as well known. Thus in this embodiment, the patterns are each formed up with eighteen stitches in accordance with the configurations of pattern cams 5.

The pattern cycle detecting cam 6 has a tapered notch 7 provided on one side diametrically outward thereof and peripherally opened as shown. The notch 7 is to cooperate with a pin 14 as will be mentioned in detail. A pattern cycle selecting cam 8 and a releasing cam 9 are secured to a transverse control shaft 10 which is to be manually rotated by way of an external dail 11. As shown in FIG. 1, the pattern cycle selecting cam 8 is formed with a peripheral notch A at a smaller diameter thereof and other peripheral notches B, C and D at a larger diameter thereof.

A shaft 16 is fixed in the machine housing lengthwise thereof. An elongated support 13 is turnably mounted on the shaft 16. The support 13 is also displaceable axially of the shaft 16. The support 13 is bent down at the leftward end thereof to form a down-extended arm 13*a* adjacent to the pattern cycle detecting cam 6 as shown in FIG. 1. The follower pin 14 is secured to the lower end of the arm 13*a*. The support 13 is provided with a follower 12 for cooperating with the pattern cycle selecting cam 8. A U-shaped member 20 is turnably mounted on the shaft 16 and is prevented from displacement axially of the shaft 16. The U-shaped member 20 is provided with a follower pin 21 which is to cooperate with the releasing cam 9. The upper end 21*a* of the follower pin 21 is located in the same plane with the elongated support 13. A coiled spring 15 is arranged between the support 13 and the U-shaped member 20 as shown in FIG. 1 to normally bias the support 13 in the leftward direction, thereby to normally press the follower 12 against the pattern cycle selecting cam 8. The support 13 is biased in one direction around the shaft 16 by a spring (not shown) and the follower pin 14 is normally pressed against the front face of the pattern cycle detecting cam 6 in which the tapered notch 7 is provided.

Therefore, if the control shaft 10 is rotated in the clockwise direction by way of the operating dail 11, the follower pin 21 is engaged by a heightened part of the releasing cam 9, and the U-shaped member 20 is turned in the clockwise direction in FIG. 2. Thus the upper end 21*a* of the follower pin 21 turns the support 13 in the clockwise direction in FIG. 2 against the action of the spring (not shown). The follower pin 14 is, therefore, moved away from the front face of the pattern cycle detecting cam 6, even if the follower pin 14 is in engagement with the notch 7. If any one of the notches A, B, C and D comes to engage the follower 12, then a lowered part of the releasing cam 9 comes to face the follower pin 21. The support 13 is, therefore, turned in the counterclockwise direction in FIG. 2 by the spring (not shown), and the follower pin 14 is pressed against the front face of the pattern cycle detecting cam 6.

According to the embodiment of the invention, when the follower 12 engages the notch A at the smaller diameter of the pattern cycle selecting cam 8, the ordinary stitching is selected. In this case, the follower pin 14 will not engage the notch 7 of the pattern cycle detecting cam 6 during rotation of the latter, because the follower pin 14 is located diametrically beyond the notch 7. If the follower 12 engages any of the notches B, C and D at the larger diameter of the pattern cycle selecting cam 8, the support 13 is displaced against the action of the spring 15 in the rightward direction, and the follower pin 14 is displaced in the diametrically outward direction of the pattern cycle detecting cam 6. Thus the follower pin 14 is positioned to engage the notch 7 of the cam 6 during rotation of the latter. According to the embodiment of the invention, the notches B, C and D of the pattern cycle selecting cam 8 are employed to select one-cycle, two-cycle and three-cycle stitching of a pattern respectively.

As shown in FIGS. 2 and 3, a switch SW1 is provided, which has an actuator 17 to be operated by displacement of the support 13 axially of the shaft 16. The actuator 17 is, therefore, normally in contact with a transversely enlarged part 18 of the support 13. Thus the switch SW1 is operated to set the sewing machine for a high speed operation when the notch A of the pattern cycle selecting cam 8 engages the follower 12. On the other hand, when the notches B, C and D engage the follower 12 respectively, the switch SW1 is operated to set the sewing machine for a lower speed operation. A pattern cycle detecting switch SW2 is provided, which has an actuator 19 to be operated by turning movement of the support 13 around the shaft 16. The switch SW2 is, therefore, operated when the follower pin 14 is dropped into the notch 7 of the pattern cycle detecting cam 6. Thus the switch SW2 detects the termination of one-cycle stitches of a pattern and produces a signal.

In reference to FIGS. 1 and 2, a belt wheel 22 is mounted on the end part of the upper drive shaft 2, and is connected to a machine drive motor (not shown) by way of a transmission belt 23. The rotation of the belt wheel 22 is transmitted to the upper drive shaft 2 through a clutch mechanism (not shown) provided between the belt wheel 22 and the upper drive shaft 2. A stopper cam 24 with an abutment 25 is secured to the upper drive shaft 2 adjacent to the belt wheel 22. A pawl 26 is at the intermediate thereof turnably mounted on a pivot 28, and is operatively connected through a link 29 to a plunger 30 of an electromagnetic solenoid SOL. The link 29 is normally biased in the clockwise direction, in FIG. 2 by a tension spring 31, so as to normally hold the upper end 27 of the pawl 26 in a position away from the rotation path of the stopper cam 24.

If the solenoid SOL is energized to pull down the plunger 30, the link 29 is turned in the counterclockwise direction against the action of spring 31. As a result, the pawl 26 is turned in the clockwise direction, and the upper end 27 is brought with the rotation path of the stopper cam 24 and engages the abutment 25 of the stopper cam 24. Thus the rotation of the stopper cam 24 and therefore of the upper drive shaft 2 is blocked. Simultaneously the clutch mechanism (not shown) is operated to disconnect the upper shaft 2 from the belt wheel 23, and simultaneously a switch SW3 is operated by the link 29 to interrupt the electric power to the machine drive motor (not shown). Thus the sewing machine is designed to stop with the needle stopped at a predetermined position.

Figure 4:
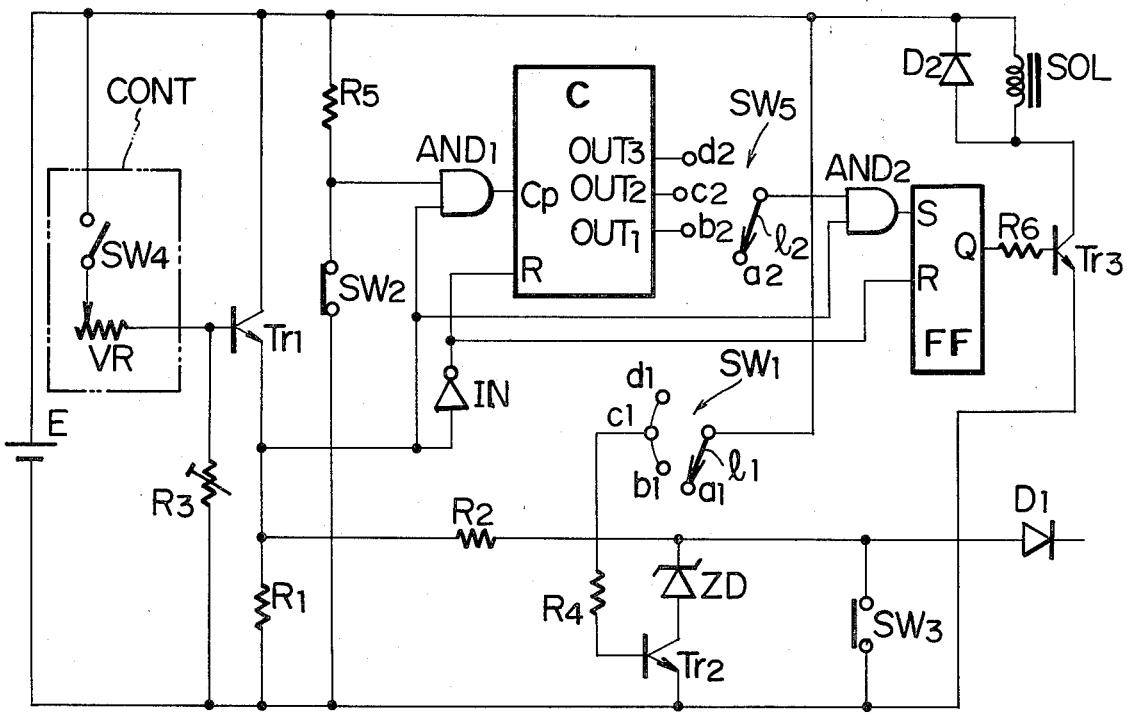
FIG. 4 is a control circuit of the invention.

In reference to FIG. 4 showing a control circuit of the sewing machine, E is a control power source of a constant voltage. CONT is a user-operated controller which is operated to vary a resistance value of a variable resistor VR, thereby to vary the base current of a transistor Tr1, and then to vary the voltage of an emitter resistor R1, in effect to control the speed of the machine drive motor (not shown) through a resistor R2 and a diode D1. SW4 is a normally opened switch which is closed as the controller CONT is operated. R3 is a resistor for adjusting the sensitivity of the transistor Tr1.

The operation speed changing switch SW1 has a movable contact element (l1) which is operated to selectively connect to fixed contacts (a1, b1, c1, d1) in accordance to the engagement of the follower 12 with the notches A, B, C, D of the pattern cycle selecting cam 8. When the contact element (l1) is connected to the fixed contact (b1, c1, or d1), the transistor Tr2 is activated to vary the voltage of the drode D1 into a constant low value through the voltage of a Zenor diode ZD, thereby to control the machine drive motor at a low speed. When the contact element (l1) is connected to the fixed contact (a1), a normal speed control of the machine drive motor is made by manipulation of the user-operated controller CONT as mentioned above.

R4 is a resistor for the base of transistor Tr2. The motor stopping switch SW3 is closed to nullify the potential of the diode D1, thereby to interrupt the electric current to the machine drive motor as the blocking pawl 27 is brought into the rotation path of the stopper cam 24. C is a counter which has a reset terminal R connected to the emitter of the transistor Tr1 through an inverter IN. The reset condition of the counter C is released when the controller switch SW4 is closed. The counter C has a pulse input terminal Cp connected to the input of AND circuit AND1, and counts up a rising signal which is produced by the pattern cycle detecting switch SW2 each time when the latter is closed as the follower pin 14 engages the notch 7 of the pattern cycle detecting cam 6 while the controller switch SW4 is closed. R5 is a pull up resistor. Further the counter C has output terminals OUT1, OUT2, OUT3 for producing high level signals respectively when the counter counts up 1, 2 and 3. These output terminals are connected to the fixed contacts (b2, c2, d2) of the switch SW5 respectively. The movable contact element (l2) of the switch SW5, which is moved together with the contact element (l1) of the switch SW1, is connected to the input side of AND circuit AND2 which has an output connected to a set terminal of a flip-flop circuit FF. Therefore, if the contact element (l2) is connected to one of the fixed contacts (b2, c2, d2) while the controller switch SW4 is closed, the high level signal of the counter C is applied to the set terminal S of the flip-flop circuit FF. The pulse signal of the counter C is not transmitted to the flip-flop circuit when the contact element (l2) is connected to the fixed contact (a2). The flip-flop circuit FF has a reset terminal R connected to the emitter of the transistor Tr1 through the inverter IN. The flip-flop circuit FF has an output Q connected to the base of a transistor Tr3 through a resistor R6, and is set to energize the solenoid SOL to move the blocking pawl 27 into the rotation path of the stopper cam 24. D2 is a free-wheel diode.

With the structure of the invention as mentioned above, if the notch C of the pattern cycle selecting cam 8 is brought to engage the follower 12 by manipulation of the operating dial 11 so as to select two-cycle stitching of a pattern (forming up two patterns of stitches in succession), the movable contact element (l1) of the switch SW1 is connected to the fixed contact (c1), and the movable contact element (l2) of the switch SW5 is connected to the fixed contact (c2) while the follower pin 14 is displaced to a position ready to engage the notch 7 of the pattern cycle detecting cam 6.

While the follower pin 14 is out of engagement with the notch 7 of the pattern cycle detecting cam 6, the switch SW2 is closed, the transistor Tr1 is not activated, the counter C and the flip-flop circuit FF are in a reset condition, the solenoid SOL is not energized, and the transistor Tr2 has an electric current applied to the base thereof, and thus the machine drive motor is ready to rotate at a low speed.

If the controller CONT is manipulated, the transistor Tr1 is activated, and the counter C and the flip-flop circuit FF are low level at the reset terminal R. As the sewing machine is driven, and the follower pin 14 comes to engage the notch 7 of the pattern cycle detecting cam 6, the counter C becomes high level at the output OUT1 thereof. The output is, however, transmitted nowhere.

When the follower pin 14 comes to engage the notch 7 again after one-cycle of a pattern of eighteen stitches has been formed up once again, the output OUT2 of the counter C becomes high level for setting the flip-flop circuit FF, thereby to energize the solenoid SOL so as to block the rotation of the stopper cam 24 and therefore of the upper drive shaft 2. Simultaneously the switch SW3 is closed to interrupt the electric power to the machine drive motor, and simultaneously the clutch mechanism, though it is not shown, is operated to disconnect the upper drive shaft 2 from the belt wheel 22. Thus the sewing machine is automatically stopped with the needle stopped at a predetermined position, after two stitch patterns have been formed up in succession.

Then if the controller CONT is released, the switch SW4 is opened, and therefore the counter C and the flip-flop circuit FF are reset, and the solenoid SOL is deenergized to open the switch SW3 and return the blocking pawl 27 to the inoperative position spaced from the rotation path of the stopper cam. At the same time the clutch mechanism is operated to connect the upper drive shaft 2 to the belt wheel 22. Thus the sewing machine is ready to produce the pattern in the subsequent two-cycle stitches. In order to start the sewing machine from the predetermined initial stitch of a selected pattern, the machine operator is capable of finding the starting point of the pattern cam by idly driving the sewing machine until the follower pin 14 engages the notch 7 of the pattern cycle detecting cam 6 to stop the sewing machine.

The other one cycle and three-cycle stitching of a pattern may be available in same manner by engagement of the follower 12 with the notches 13 and D of the pattern cycle selecting cam 8. The normal or conventional stitching of a pattern may be available by engagement of the follower with the notch A of the pattern cycle selecting cam 8, thus by nullifying the operation of the speed control switch SW1, and of the pattern cycle detecting cam 6, and therefore of the pattern cycle detecting switch SW2.

It will be understood that each of the elements described above, or two or more together, may also find a useful application in other types of constructions differing from the types described above.

While the invention has been illustrated and described as embodied in a sewing machine with a cyclic pattern stitching device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sewing machine, comprising a group of pattern cams arranged to cooperate with a needle to produce a pattern per cycle rotation thereof; a user-operated pattern selecting device arranged to be manipulated for selecting said pattern cams to control a lateral swinging movement of the needle; a machine stopping device; pattern cycle selecting means operated to select one of pattern cycles to automatically stop the sewing machine after a selected pattern has been formed up in a selected pattern cycle, said pattern cycle selecting means including a pattern cycle selecting cam, a follower cooperating with said pattern cycle selecting cam, and a transmission element connected to said follower and arranged to be swingable and linearly displaceable; means for detecting a termination of a pattern cycle and producing an electrical signal each time it detects the termination of the pattern cycle; counter means responding to a predetermined number of the electrical signals of said pattern cycle detecting means to produce a pulse signal; machine stopping means responding to the pulse signal of said counter means to operate said machine stopping device to stop the sewing machine; and a switch operated by the linear displacement of said transmission element to vary an operation speed of the sewing machine.

2. A sewing machine, comprising a group of pattern cams arranged to cooperate with a needle to produce a pattern per cycle rotation thereof; a user-operated pattern selecting device arranged to be manipulated for selecting said pattern cams to control a lateral swinging movement of the needle; a machine stopping device; pattern cycle selecting means operated to select one of pattern cycles to automatically stop the sewing machine after a selected pattern has been formed up in a selected pattern cycle; means for detecting a termination of a pattern cycle and producing an electrical signal each time it detects the termination of the pattern cycle; counter means responding to a predetermined number of the electrical signals of said pattern cycle detecting means to produce a pulse signal; machine stopping means responding to the pulse signal of said counter means to operate said machine stopping device to stop the sewing machine; and a switch arranged to operate in association with manipulation of said pattern cycle selecting means to regulate a pulse generating operation of said counter means in dependence upon a pattern cycle selection by said pattern cycle selecting means.

3. A sewing machine as defined in claim 2, wherein said pattern cycle selecting means includes a pattern cycle selecting cam, a follower cooperating with said pattern cycle selecting cam, and a transmission element connected to said follower and arranged to be swingable and linearly displaceable.

4. A sewing machine as defined in claim 3, wherein said pattern cycle detecting means includes a pattern cycle detecting cam rotating with said pattern cams to indicate each complete rotation of said pattern cams by way of swingably operating said transmission element, and a switch operated by the swinging movement of said transmission element to produce an electrical signal.

* * * * *